US006526846B1

(12) United States Patent
Duppong et al.

(10) Patent No.: US 6,526,846 B1
(45) Date of Patent: Mar. 4, 2003

(54) FOLDING FOOT PEDAL FOR VEHICLE DRIVE CONTROL

(75) Inventors: Gerald J. Duppong, Bismarck, ND (US); Corey S. Fisher, Bismarck, ND (US)

(73) Assignee: Clark Equipment Company, Woodcliff Lake, NJ (US)

( * ) Notice: Subject to any disclaimer, the term of this patent is extended or adjusted under 35 U.S.C. 154(b) by 0 days.

(21) Appl. No.: 09/564,739

(22) Filed: May 4, 2000

(51) Int. Cl.[7] ..... G05G 1/18

(52) U.S. Cl. ..... 74/564; 74/562; 74/512; 74/560; 74/478.5

(58) Field of Search ..... 74/473.16, 473.17, 74/478, 478.5, 480 R, 481, 482, 512–514, 560–562, 562.5, 564, FOR 101

(56) References Cited

U.S. PATENT DOCUMENTS

| | | | | | |
|---|---|---|---|---|---|
| 1,831,736 | A | | 11/1931 | Brandt, Jr. | |
| 1,918,218 | A | | 7/1933 | Sweeny | |
| 2,485,759 | A | | 10/1949 | Miller | 74/481 |
| 3,250,146 | A | * | 5/1966 | Schlosser | 74/478.5 |
| 3,431,793 | A | | 3/1969 | Boston | 74/512 |
| 3,431,993 | A | | 3/1969 | Case | 180/6.48 |
| 3,602,062 | A | | 8/1971 | Houk | 74/481 |
| 3,635,316 | A | * | 1/1972 | Rogers et al. | 74/478.5 |
| 3,693,471 | A | * | 9/1972 | Glance | 74/518 |
| 3,857,298 | A | | 12/1974 | Case | 74/469 |
| 3,995,510 | A | * | 12/1976 | Yost | 74/478.5 |
| 4,026,164 | A | * | 5/1977 | Mozingo | 74/478.5 |
| 4,037,487 | A | | 7/1977 | Ahlschwede et al. | 74/529 |
| 4,237,752 | A | | 12/1980 | Hildebrecht | 74/878 |
| 4,245,527 | A | * | 1/1981 | Hildebrecht | 74/478 |
| 4,291,778 | A | | 9/1981 | Slazas | 180/271 |
| 4,299,136 | A | * | 11/1981 | Turi et al. | 74/478.5 |
| 4,516,439 | A | | 5/1985 | Sagaser | 74/470 |
| 4,523,489 | A | | 6/1985 | Gault | 74/474 |
| 4,543,850 | A | | 10/1985 | Bednar et al. | 74/512 |
| 4,938,091 | A | | 7/1990 | Waggoner et al. | 74/471 |
| 5,197,347 | A | | 3/1993 | Moffitt et al. | 74/481 |
| 5,216,935 | A | * | 6/1993 | Shimamura et al. | 74/512 |
| 5,552,807 | A | | 9/1996 | Hayes et al. | 345/156 |
| 5,553,992 | A | | 9/1996 | Ashcroft | 414/685 |
| 5,927,153 | A | * | 7/1999 | Bhangoo et al. | 74/512 |
| 6,170,355 | B1 | * | 1/2001 | Fay, III | 74/478.5 |

FOREIGN PATENT DOCUMENTS

| | | | | |
|---|---|---|---|---|
| AT | 229154 | * | 8/1963 | 74/562.5 |
| DE | 422137 | * | 11/1925 | 74/564 |
| DE | 581754 | * | 8/1933 | 74/564 |

* cited by examiner

*Primary Examiner*—Chong H. Kim
(74) *Attorney, Agent, or Firm*—Westman, Champlin & Kelly, P.A.

(57) ABSTRACT

A foot pedal control for controlling operations of a machine has a folding foot pedal assembly that has two sections that pivot relative to each other, and both sections are pivoted relative to a platform of the machine. The two pedal sections will pivot relative to each other from a first folded position where they nest together with foot rest portions closely adjacent, to a second position where the foot rest portions are separated and will support a foot. In the position with the foot rest portions separated, both of the sections will pivot around a common axis to provide movement of a control link when using the foot operated pedal. The folded pedals can be locked from pivoting to then serve as a foot rest.

11 Claims, 7 Drawing Sheets

FOLDING FOOT PEDAL FOR VEHICLE DRIVE CONTROL

BACKGROUND OF THE INVENTION

The present invention relates to foot pedals for controlling various control functions on a machine, such as an excavator, which will fold to reduce floor space occupied by the pedals and which can be locked in folded position and used as foot rests. The foot pedals are used for operating the actuators on a digging machine, such as a an excavator, in particular, and will be used only intermittently. The existing foot pedals take up a substantial amount of floor space that could be usable for leg movement of the machine operator. The present invention provides foot pedals that can be folded to increase the available floor space when the foot pedals are not going to be used for a time, and which can be locked so the pedals can be used as foot rests.

The prior art shows various hand/foot controls that operate valves for propelling a machine, or for doing other tasks, such as the controls for a skid steer loader shown in U.S. Pat. No. 5,553,992. For excavator drives, the foot pedals operate by pivoting about a horizontal axis from a centered position to actuate a valve to control movements from a neutral position.

Additionally, there are prior art brake locks that lock a foot pedal in one position. Such locks can be used on drive controls as well.

However, the use of a locked pedal does not solve the problem of maximizing the available floor space and providing a foot rest for operator comfort during times when the foot pedals are not likely to be activated.

SUMMARY OF THE INVENTION

The present invention relates to a control pedal arrangement used on powered machines or implements, such as excavators. The excavators have auxiliary hydraulic actuators and a boom swing actuator as well as drive tracks which are driven with hydraulic motors in either forward or reverse directions. The auxiliary actuator and the boom swing actuators are controlled by valves that are operated by pivoting foot pedals. The pedals can be pivoted "toe down" from a neutral position for one direction of movement and "heel down" from the neutral position for the opposite direction. The motors for the drive tracks are normally controlled by valves operated with hand levers, but the present invention permits fast pedal operation. Steering is obtained by driving one track only, or driving the tracks on opposite sides of the machine in opposite directions.

Additionally, excavators have booms and buckets that are operated through hydraulic controls using joy sticks for the boom and bucket and slew motors, which rotate the excavator frame.

The present invention in one aspect relates to foot pedals for operating valves that have sections that fold together to reduce the overall size, in order to free up platform space for the feet of the operator. The folding pedals have flanges on which the hand levers can be fixed, so that as an option, rather than using the hand levers, the pedals can be unfolded and the drive motors for the tracks operated with foot pedals.

The foot pedals used for the auxiliary hydraulics and the boom swing actuator can be folded and locked in position so that they will not move. When locked in position, the folded foot pedals can be used as foot rests in addition to freeing up space on the platform for the operator's feet.

The foot pedals are made in two sections and mounted on a common pivot. When folded, but unlocked, the pedals can still be pivoted in one direction, and then when unfolded can be rocked from a central neutral position to provide opposite directions of operation of hydraulic actuators and motors.

The ability to fold and lock the pedals that operate the auxiliary actuators and swing provides several advantages, including the ability to hold the pedals in a neutral position and then adjust the control link lengths until the valve that is being controlled is in its neutral position. The pedal lock member is mounted onto a common mounting block with the pedals so that the locked or fixed position of the pedals is repeatable and precise.

The two sections of the pedals are held in their open or working position with a pin that is mounted on one of the pedal sections and engages a retainer lug on the other pedal section. The same pin also is used as a latch with the lock member for holding the folded foot rest in its locked position.

The pedals are easily operated and when folded free up floor space as well as providing a fixed position for the pedals so that they can be used as foot rests. When the pedals are locked, the controlled actuators will not be moved accidentally during operation of the excavator. The folding pedal also can be used to mount levers for providing normal hand lever actuation of the drive motors and upon unfolding of the pedal, the drive motors can be foot operated.

DETAILED DESCRIPTION OF THE ILLUSTRATIVE EMBODIMENTS

Figure 1:
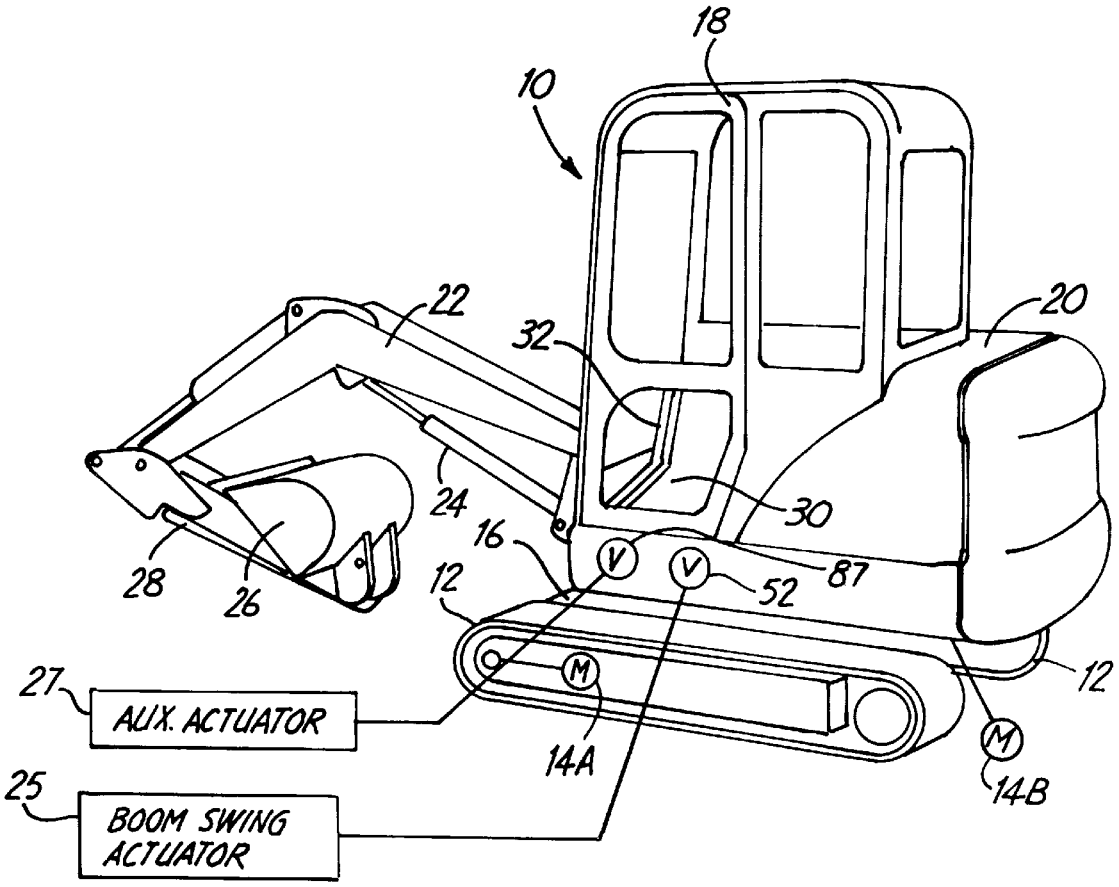
FIG. 1 is a schematic view of a typical excavator on which the drive pedals of the present invention are installed.

A mini excavator on which the control pedals of the present invention are used is illustrated generally 10. The excavator has drive tracks 12 that are on opposite sides of a frame 16, and which are used for moving the excavator 10 across the ground. The tracks 12 are driven by separate hydraulic motors indicated at 14A and 14B, for the two sides of the frame 16. By driving both tracks 12 simultaneously in the same direction the excavator 10 can be moved forward or backward, and by driving one track or the other, or driving the tracks in opposite directions, the excavator frame can be turned in a normal manner. The excavator 10 includes an operator's cab 18, and it has an engine compartment 20 in which an engine is mounted and it is used for providing hydraulic power. Additionally, there is a boom 22 that is operated with a hydraulic cylinder 24, and a bucket 26 operated with a hydraulic cylinder 28. These cylinders 24 and 28 are controlled from interior controls, generally a joy stick control that is on an operator's platform shown generally at 30 of the interior of the cab 18. The excavator boom is mounted on an upright pivot that permits the boom to rotate or swing side to side with an actuator 25 in a conventional manner, and also there is an auxiliary actuator 27 that is controlled by an operator. The operator would sit at an operator's seat (not shown) and operate controls that are shown generally at 32 for selectively driving the motors 14A and 14B and moving the actuators or cylinders 25 and 27.

Figure 2:
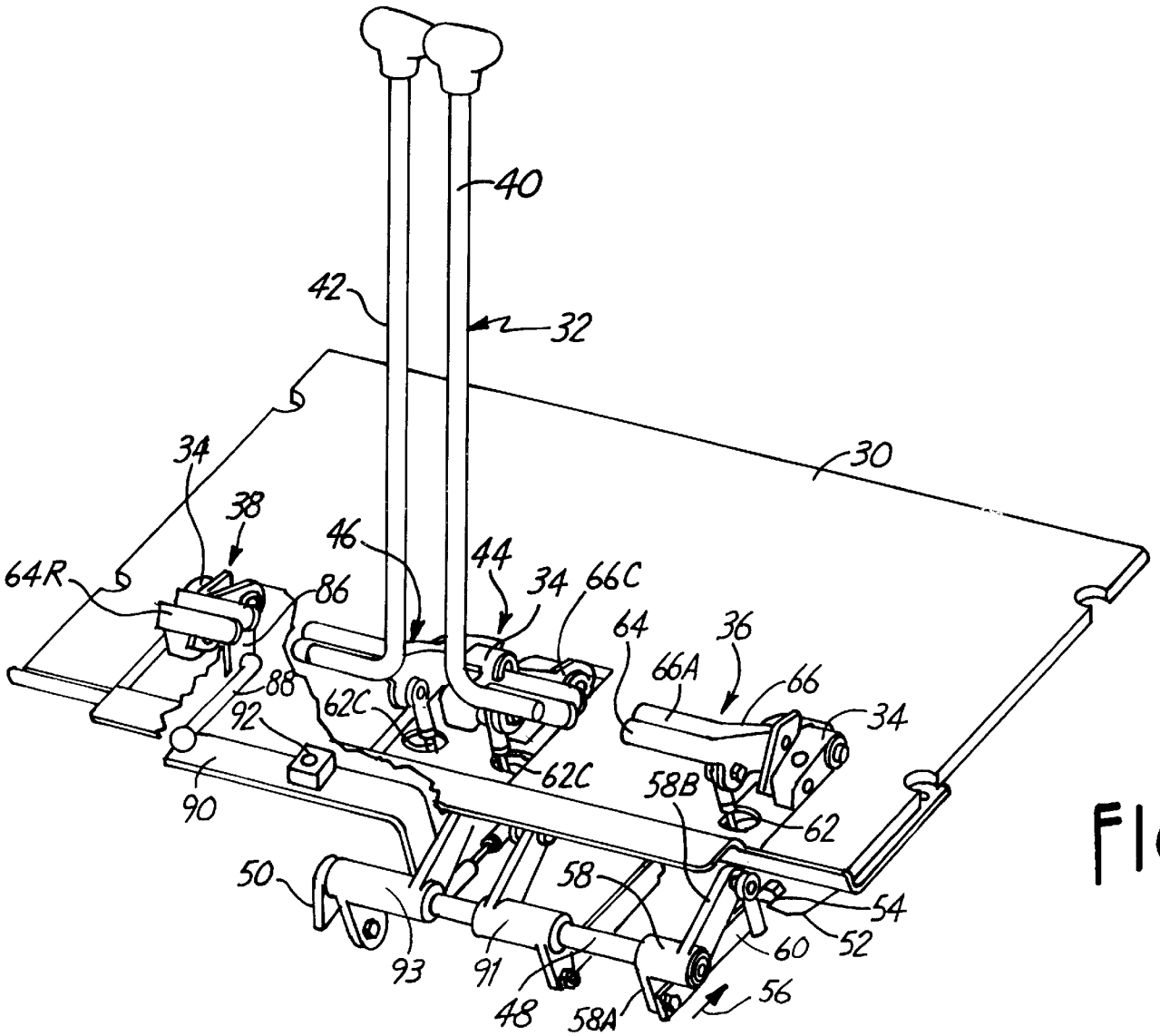
FIG. 2 is a perspective view of a platform portion of an excavator showing the controls including drive pedals made according to the present invention in place.

FIG. 2 is a schematic representation of the platform 30 of the excavator, including foot pedals made according to the present invention. In FIG. 2, the platform 30 is shown in a perspective view taken from a different angle than FIG. 1, with the various operator controls indicated at 32 in position. The controls 32 that are shown, are in the forward portion of the cab, and the operator would sit to the rear. The platform 30 and cab 18 can be selectively rotated relative to the frame and tracks.

The platform 30 has a plurality of mounting blocks or hubs 34 that provide housings for pivotally mounting controls, including folding auxiliary and boom swing pedal assemblies 36 and 38, on the left and right hand sides of the platform 30, respectively. The pedal assemblies 36 and 38 are identically made insofar as the folding action is concerned, except one is left hand and one is right hand, and the connections on the pedals for connecting links to valves are different to accommodate to the different positions of the pedals on the platform 30.

Additionally, a pair of hand control levers 40 and 42, respectively, are provided on the platform. They also are left and right hand levers and are used for controlling valves for motors 14A and 14B, and thus control travel of the excavator. The levers 40 and 42 in turn are mounted onto folding pedal assemblies 44 and 46, which again, as will be explained, fold in the same manner as the pedal assemblies 36 and 38, but are different in construction in that they do not lock together in folded position. The foot pedals may be used for convenience for controlling travel when the operator's hands are occupied with other tasks, and the excavator should be moved.

A shaft 48 is positioned below the platform 30 and is supported on the frame 16 of the excavator on suitable supports one of which is schematically shown at 50. The shaft 48 in turn is used for mounting bell cranks for translating the motion of the pedal assemblies as they pivot on their mountings into linear motion for actuating hydraulic valves.

There is typically a valve 52 that has a linear acting spool member 54 that moves in and out in the direction that is indicated by the double arrow 56. Typically, for actuation, this linear motion is achieved using a bell crank assembly or similar pivoting member. A bell crank 58 is mounted on the shaft 48, and has an arm 58A that controls a link 60 that operates the spool 54. The bell crank 58 also has an arm 58B that extends to a position underneath the platform 30, and is connected with a link 62 to the front pedal section 64 of pedal assembly 36.

Figure 3:
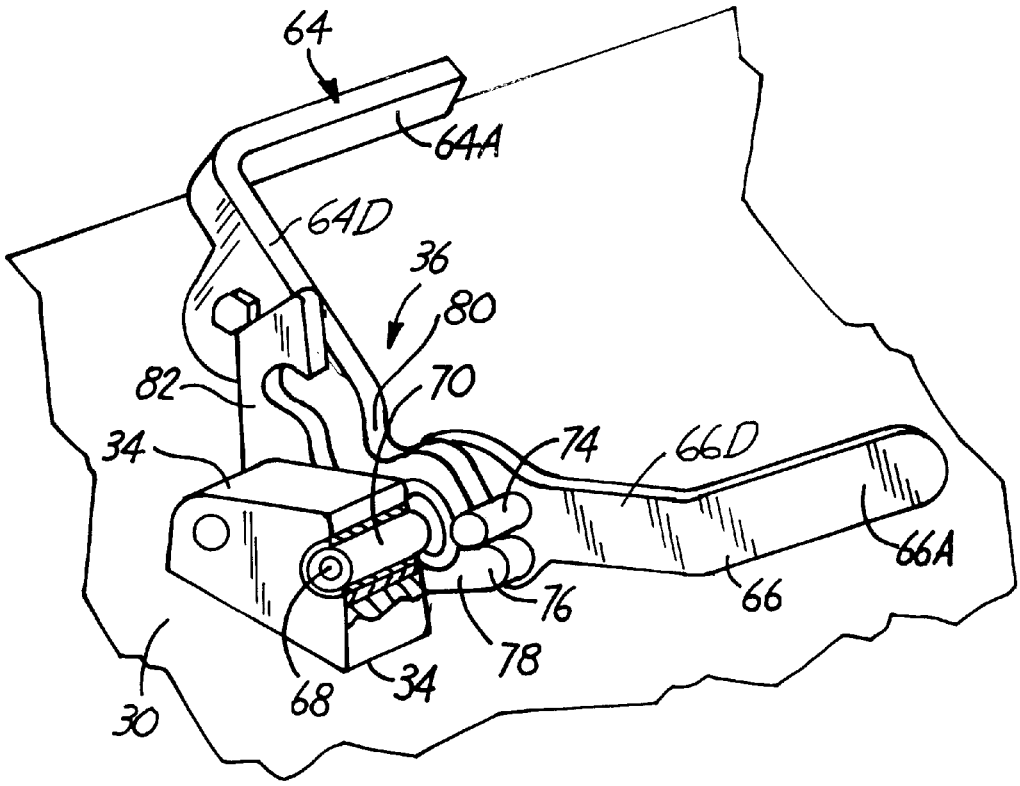
FIG. 3 is a perspective view of the left hand pedal of FIG. 2 in an open or working position.
Figure 6:
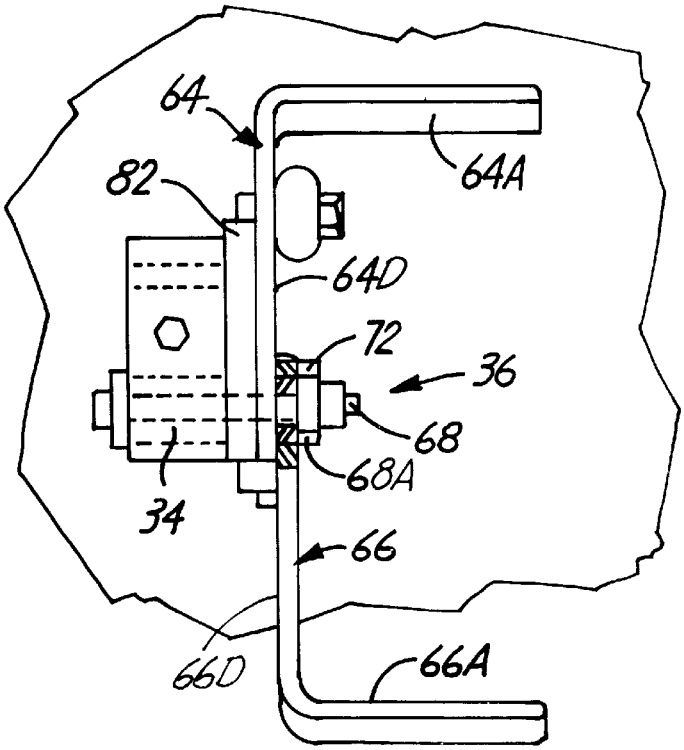
FIG. 6 is a top plan view of the pedal of FIG. 3 in its open position.

The pedal assembly 36 is shown in its folded and locked position in FIG. 2 as a typical showing. FIG. 3 illustrates pedal assembly 36 in its open or usable position for pivoting or rocking back and forth about its pivot axis from a neutral position. The pedal assembly 36 includes the front or forward pedal section 64, and a rear pedal section 66, both of which are pivotally mounted about an axis defined by the center of a mounting bolt 68 supported in the hub 34 on the left hand side of the platform. The forward pedal 64, as shown, has a pivot sleeve 70 attached thereto, which is mounted for pivotal movement in the hub or mount 34, and the sleeve 70 has a center bore through which the bolt 68 passes. The rear pedal section 66 mounts over a short pivot support sleeve 72 (see FIGS. 6 and 6A where the rear pedal section is broken away) fixed on the front pedal section 64. The bolt or pivot pin 68 passes through sleeve 72, and with a washer 68A, holds the rear pedal section 66 in position. Thus the rear pedal section 66 can pivot on the sleeve 72 relative to the front pedal section 64, and both pedal sections 64 and 66 can pivot about the axis of the pin 68 in the hub 34. The pivot sleeve 70 can be supported in bushings as shown. The pedal section 64 is spaced from block 34 with a flange 71 that is fixed to sleeve 70 and pedal section 64.

Figure 7:
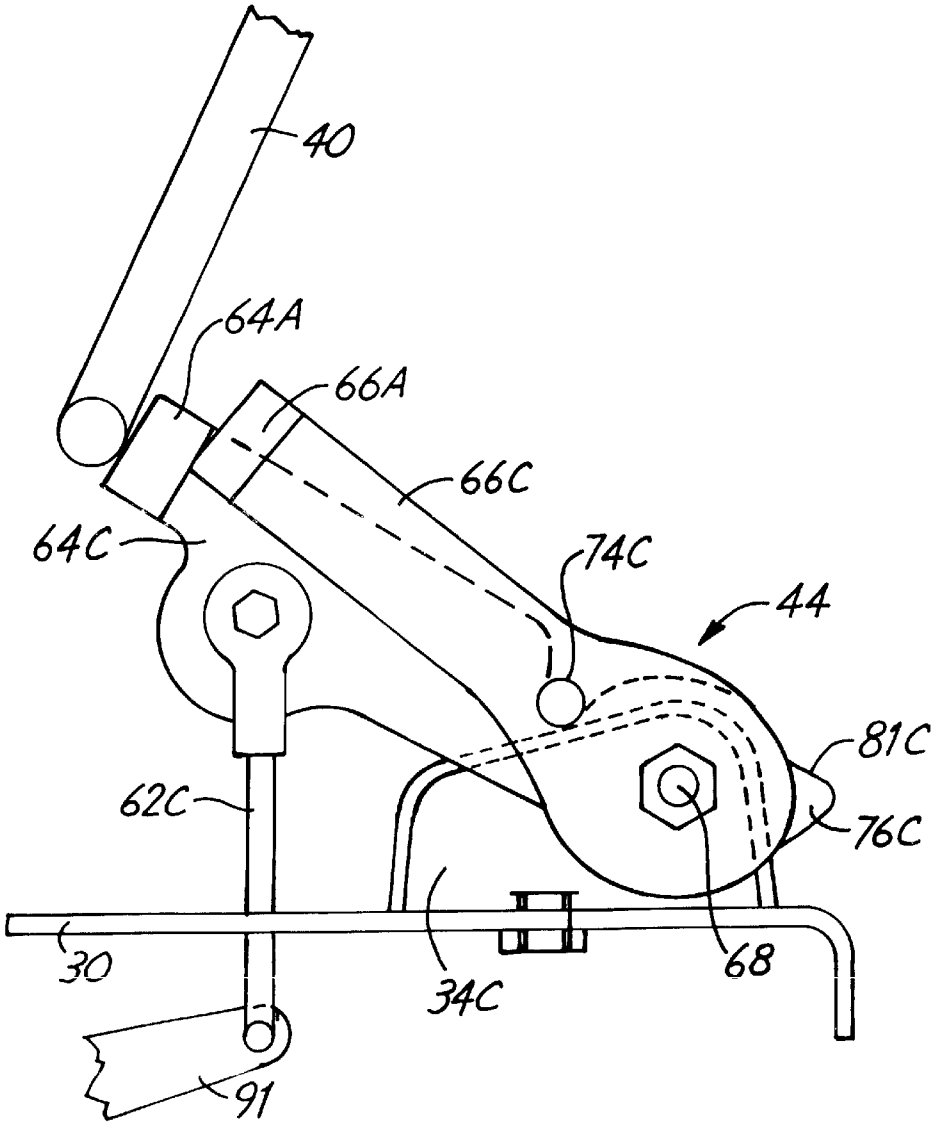
FIG. 7 is a side view showing the pedal assembly without a lock in a folded position as used in connection with the hand controls.

The pedal sections 64 and 66 have adjacent radial arms 64D and 66D that have foot support flanges 64A and 66A at their outer ends and when in its open position, as shown in FIGS. 3 and 7 the flanges 64A and 66A are spaced in fore and aft direction so they will comfortably support a foot. The foot support flanges both extend from the respective arms in the same direction from the hub or mount 34 and overlap each other.

In this open position, the pedal section 66 is held from moving or pivoting in clockwise direction as shown in FIG. 3, which would tend to separate the flanges 64A and 66A, by a pin 74 on the pedal section 66 that rests in a notch 81 formed by a lug 76 on the pedal section 64. The lug 76 is on a flange 78 on the side of the front pedal section 64. The pin 74 which moves as the pedal section 64 is pivoted will move in counterclockwise direction as shown in FIG. 3, for folding to the position shown in FIGS. 4 and 5.

In the open position, shown in FIG. 3, the two pedal sections 64 and 66 forming the pedal assembly 36 will pivot in both directions from a centered position about the axis of the pin 68. When the pedal assembly is pivoted, the connecting link 62 will be moved in a vertical path, and depending on the direction of pivoting, will move the bell crank 58 by moving the arm 58B either up or down to cause operation of the spool 54 on the valve 52.

Figure 4:
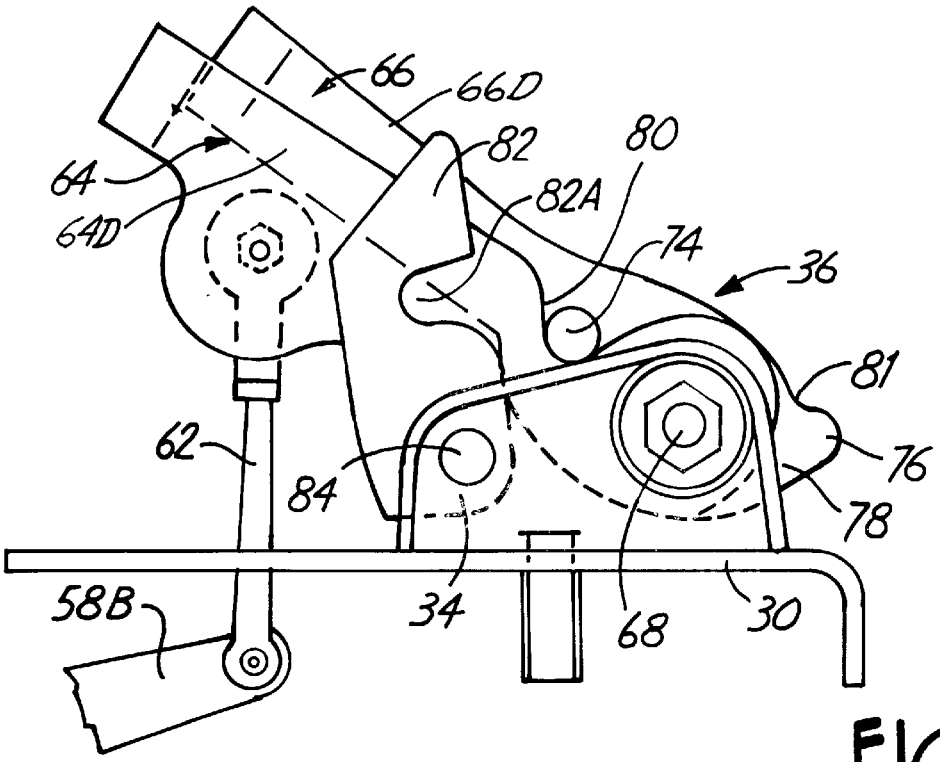
FIG. 4 is a side view of the pedal of FIG. 3 showing the pedal in a folded but unlocked position.

In the folded position of the pedals, as shown in FIG. 4, it can be seen that the pin 74 is resting in a notch 80 on the front pedal section 64, and in this position, the two pedal sections can be moved counterclockwise, so that the link 62 can be moved downwardly to operate the valve 52 to control a connected actuator such as actuator 25 for the boom swing or side to side pivoting. The spring loading on the valve toward a neutral position will cause the folding pedal and the valve 52 to move to back to its neutral position when load is removed.

Figure 5:
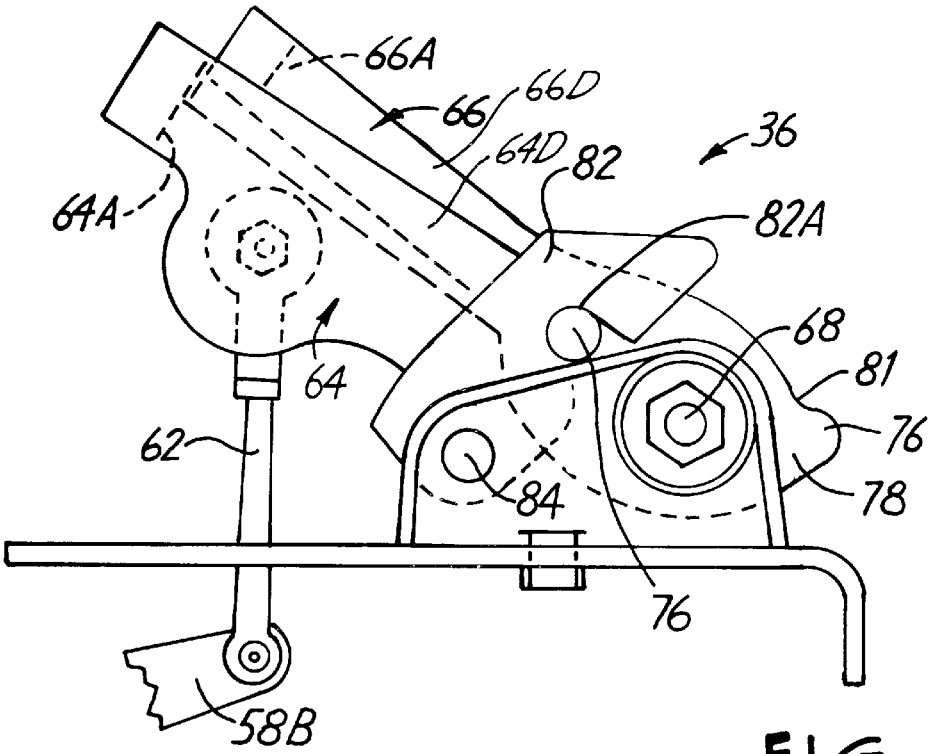
FIG. 5 is a side view similar to FIG. 4 with the pedal locked in position.
Figure 6A:
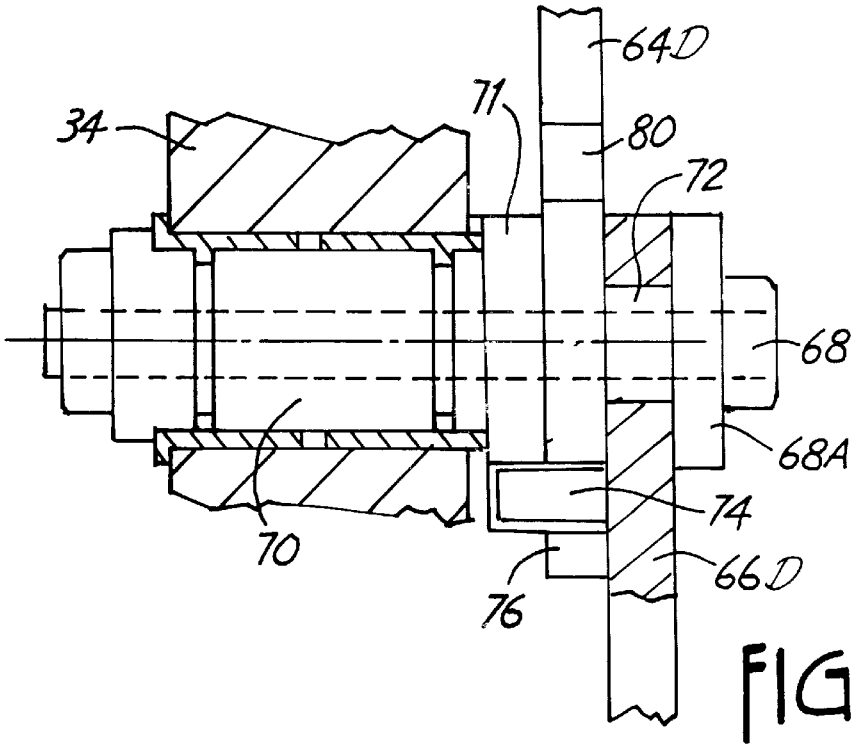
FIG. 6A is an enlarged view of the pivot region of the pedals.

The pin 74 on pedal section 66 also serves as a latch pin for locking the pedal assembly from movement. By moving a lock member 82 about its pivot pin 84, which is secured on the mounting hub 34, to its position as shown in FIG. 5, where a receptacle 82A fits over the pin 74, the pedal section 66 is locked in position, and because it is nested over the pedal 64, the pedal 64 will not be actuated. The foot will rest on the locked pedal. The pin 74 extends laterally out from the side of pedal section 64, and the lock member moves in the space created by flange 71, which is shown in FIG. 6A.

In the locked position, the pedals will not pivot. The pedals are effectively locked in place. The folded pedal assembly thus can be used as a foot rest. The pedal section 66 is the one that a foot would rest upon and it is held securely by the latch 82. Since the two pedal sections are locked in position the valve that is controlled cannot be operated. The locked position shown in FIG. 5 is the neutral position, and when the latch or lock member 82 is in place on the pin 74, the linkage can be adjusted to the zero or neutral position of the valve spool, such as that shown at 54.

The right hand pedal assembly 38 is a mirror image of the left hand pedal assembly 36 insofar as the mounting for pivoting, the folding action, and the operating action. However, as shown in FIG. 2, the front pedal section 64 on the right side has a depending arm 86, that will move a link 88 in fore and aft direction as the pedal assembly is pivoted from its centered position, and link 88 in turn will operate a lever 90 that is pivotally mounted on a pivot pin 92 to the platform 30. The outer end of lever 90 will be moved as the pedal assembly 38 pivots. The lever 90 will move in opposite directions to operate a control valve similar to valve 52 and shown schematically at 87 in FIG. 1.

The center control pedal assemblies 44 and 46, which mount the hand levers 40 and 42 are made so that they will permit operation with the hand levers or with pedals. The pedal assemblies 44 and 46 are normally folded, but can be opened for foot operation. To use the hand levers or foot pedals is an operator's choice. The pedal assemblies 44 and 46 operate in the same manner as explained in connection with the pedal assembly 36, except that there is no lock member 82 used with the center pedal assemblies. FIG. 7 is a sideview of the left hand assembly 44, similar to FIG. 4 but the lock member is eliminated. In this form of the invention, the lever 40 is illustrated on a front pedal assembly 64C. The center controls do operate control rods 62C, to move them in vertical direction to in turn operate bell cranks 91 and 93, for the two levers 40 and 42, respectively. These bell cranks 91 and 93 are also mounted on the shaft 48. The rear pedal sections 66C for the center assemblies 44 and 46 will also have pins 74C that nest in notches 81C formed by the leg 76C of the front pedal sections 64C.

Figure 8:
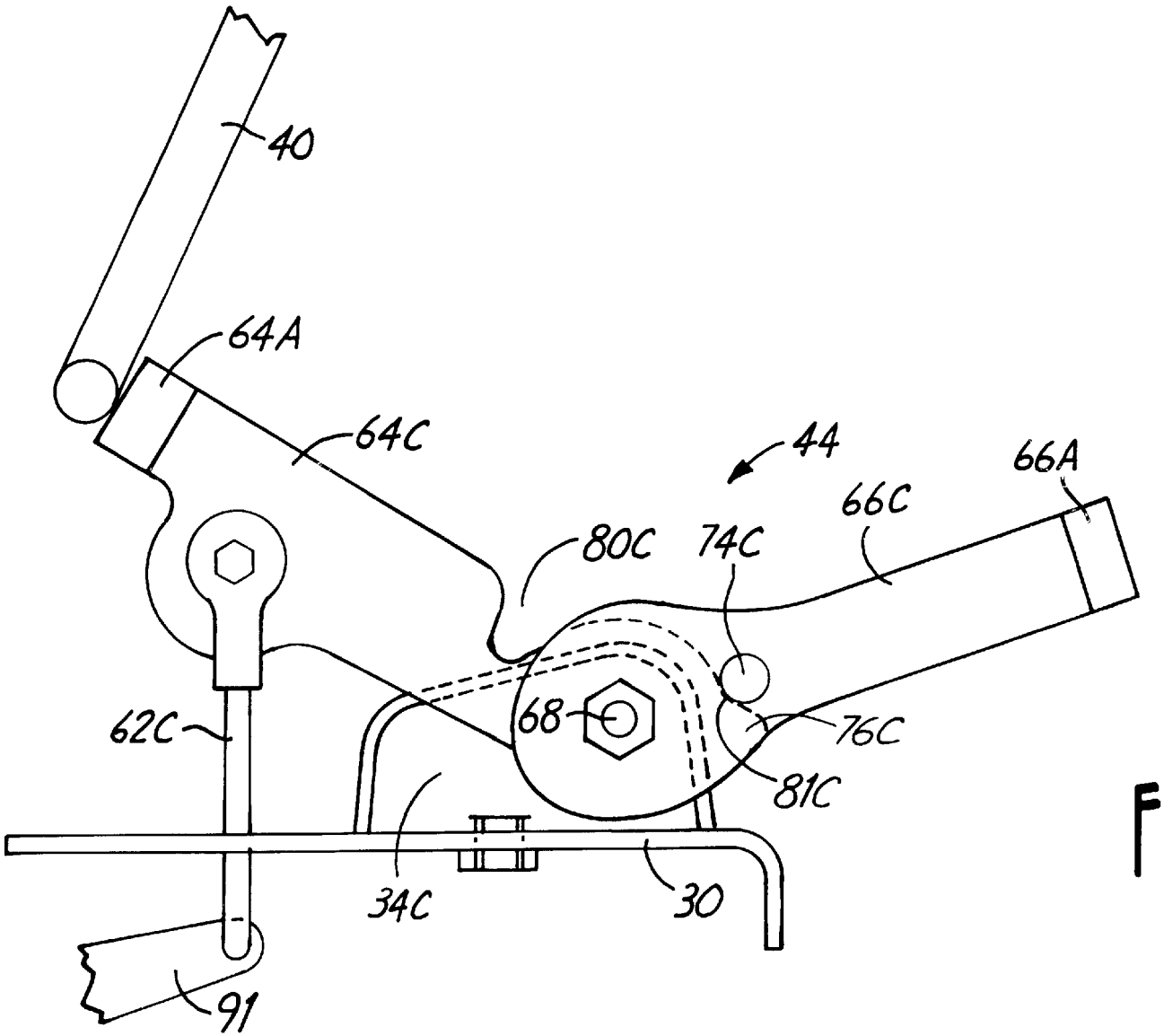
FIG. 8 is a side view of the pedal of FIG. 7 with the pedal unfolded.

The pedal section 66C can be unfolded to the position shown in FIG. 8 is for the pedal assembly 44. The control links 62C move bell cranks to operate valves for controlling the hydraulic motors 14A and 14B. The forward and reverse movement of the levers will result in forward and rearward movement of the respective track. These valves for the drive track drive motors can be operated with the feet of the operator, if desired.

When the pedals on the left and right hand side for the auxiliary and boom swing valves are locked in position, they form foot rests, and the rear pedal sections are also moved to clear up or unencumber the platform space to the rear of the pedal assembly. This permits the operator to have more foot room on the platform. The manual lock 82 can be moved to a locked position so that the pedals can be used as foot rests. The lock 82 can be moved to release the pedals with the toe so that the pedals can be pivoted to operate the actuators.

The pedal sections nest together when they fold, and the foot support flanges 64A and 66A are adjacent and nested. The flanges can remain slightly offset as shown. The flange 66A will take the foot rest load.

Although the present invention has been described with reference to preferred embodiments, workers skilled in the art will recognize that changes may be made in form and detail without departing from the spirit and scope of the invention.

What is claimed is:

1. A foot control pedal assembly for use with a vehicle having a moveable control member comprising first and second pedal sections, a hub for mounting the first and second pedal sections coaxially about a first pivot axis relative to a support, said first and second pedal sections having foot rest portions, and one pedal being movable relative to the other the first pivot axis from a position wherein the foot rest portion of the second section is adjacent to and nested with the foot rest portion of the first section, to a stopped position where the foot rest portion of the first section is separated from the foot rest portion of the second section and the first and'second sections are held from further separation and are pivotable about the first pivot axis as a unit, and an actuator on the pedal assembly coupled to move the moveable control when the pedal assembly is pivoted; a stop member for holding the pedal sections from movement relative to each other in one pivoting direction in the stopped position and permitting the pedal sections to pivot relative to each other in an opposite direction, wherein the footrest portions move together.

2. The pedal assembly of claim 1 and a lock for holding the pedal sections in their nested position, and preventing pivoting of one of the pedal sections relative to the other about the first pivot axis.

3. A pedal assembly for use with a vehicle having hydraulic valves operable by foot pedals comprising a first pedal section pivotally mounted on an axis relative to a support on the vehicle, a second pedal section pivotally mounted on the same axis as the first pedal section, the pedal sections having adjacent arms and foot rest flanges thereon that extend in the same direction from the respective arms and the footrest flanges are adjacent each other in a first position of the second pedal section, and the second pedal section being moveable about the axis to cause the foot rest flanges to separate, a stop member for holding the pedal sections in a position with the foot rest flanges separated to prevent further separation of the foot rest flanges, and an actuator on the first pedal section for operating a control.

4. The pedal assembly of claim 3 including a latch on the support and engagable with at least one pedal section for holding both pedal sections from pivoting.

5. The pedal assembly of claim 4, wherein said latch holds the pedal sections in a neutral position of the control.

6. The pedal assembly of claim 4, wherein one of the pedal sections has a pin, the other of the pedal sections has a lug engageable by the pin, the pin and lug forming the stop member and engaging when the foot rest flanges are in selected positions.

7. The pedal assembly of claim 3, and an actuator lever fixed to and extending from the foot rest flange of one of the first pedal sections.

8. The pedal assembly of claim 6, wherein the support comprises a support platform and wherein the second pedal section overlies a portion of a support platform when the foot rest flanges of the pedal sections are separated, the second pedal section moving to be clear of the portion of the support platform when the foot rest flanges of the pedal sections are adjacent each other.

9. The pedal assembly of claim 8, wherein the second pedal section carries the pin, and the pin protrudes above the other first pedal section when the pedal sections are nested the latch being engaged with the pin in a latched position so that when latched the pin and latch prevent pivotal movement of the pedal sections.

10. The pedal assembly of claim 1, wherein said pedal sections extend in fore and aft direction relative to the pivot axis of the pedal assembly when the foot rest flanges are separated, and the pedal section extending in aft direction folds forwardly to nest with the forwardly extending pedal section.

11. A pedal assembly for use with a vehicle having hydraulic valves operable by foot pedals comprising a first pedal section pivotally mounted on a first pivot relative to a support on the vehicle, a second pedal section pivotally mounted relative to the support and the first pedal section and moveable with the first pedal section about the first pivot, the pedal sections having foot rest flanges thereon that extend laterally in the same direction from the pivotal mounting and which are adjacent each other in a first position of the second pedal section, and the second pedal section being pivotable to separate the foot rest flanges, a stop member acting between the pedal sections for holding the pedal sections in a position with the foot rest flanges separated and to prevent further separation of the foot rest flanges, and an actuator on the first pedal section for operating a control when the pedal sections move about the first pivot.

* * * * *